United States Patent [19]

Koski

[11] 4,167,238

[45] Sep. 11, 1979

[54] TOBACCO POUCH WITH EJECTOR MECHANISM

[76] Inventor: Philip A. Koski, 7588 Groveland Rd., Minneapolis, Minn. 55432

[21] Appl. No.: 867,898

[22] Filed: Jan. 9, 1978

[51] Int. Cl.[2] ..... G01F 11/20

[52] U.S. Cl. ..... 222/413; 206/249; 206/260; 222/510

[58] Field of Search ..... 222/225, 322, 410, 412, 222/413, 501, 510; 206/249, 260, 253

[56] References Cited

U.S. PATENT DOCUMENTS

| | | | |
|---|---|---|---|
| 135,110 | 1/1873 | Gerike | 206/249 |
| 614,000 | 11/1898 | Hutchison et al. | 222/412 |
| 706,648 | 8/1902 | Frank | 206/253 |
| 1,476,652 | 12/1923 | Shore | 206/249 |
| 1,858,735 | 5/1932 | Goodsell | 206/249 |
| 2,505,650 | 4/1950 | Rodman | 206/260 |

*Primary Examiner*—Robert J. Spar
*Assistant Examiner*—H. Grant Skaggs
*Attorney, Agent, or Firm*—Douglas L. Carlsen

[57] ABSTRACT

A tobacco pouch having a built in framework including a discharge tube extending through one side of the pouch and a spiral type ejector mechanism having one end loosely disposed in the tube and its other end journaled for rotation in the framework portion opposite from the tube and a handle disposed outside of the pouch whereby as the handle is operated the spiral mechanism will rotate to move tobacco in the pouch out through the discharge tube into the bowl of a smoking pipe.

1 Claim, 5 Drawing Figures

FIG. 1
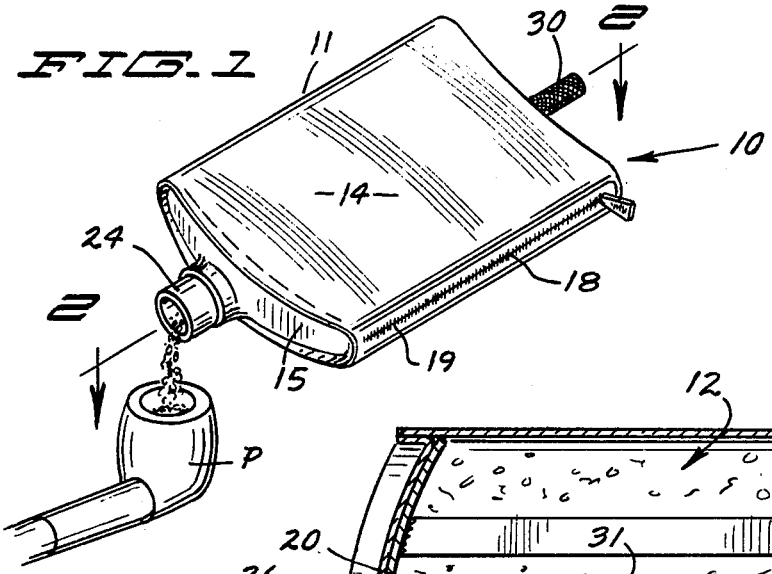
FIG. 2
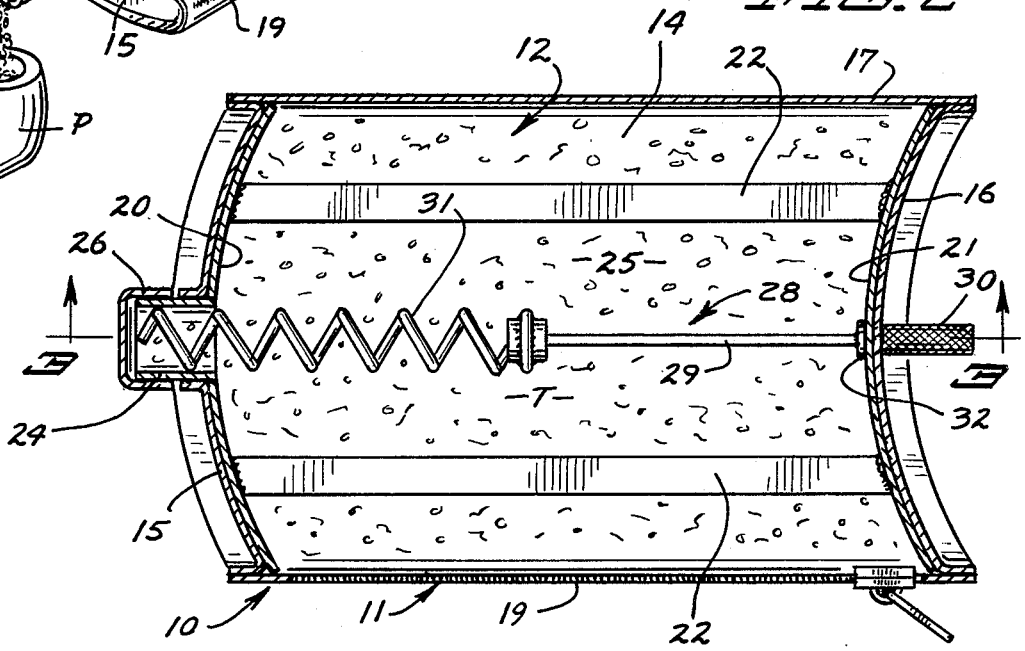
FIG. 3
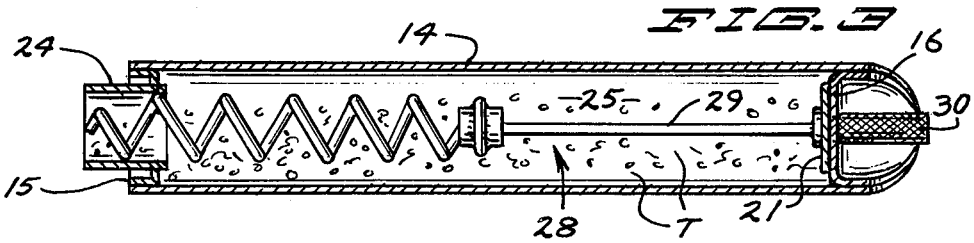
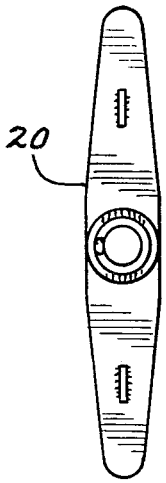
FIG. 5
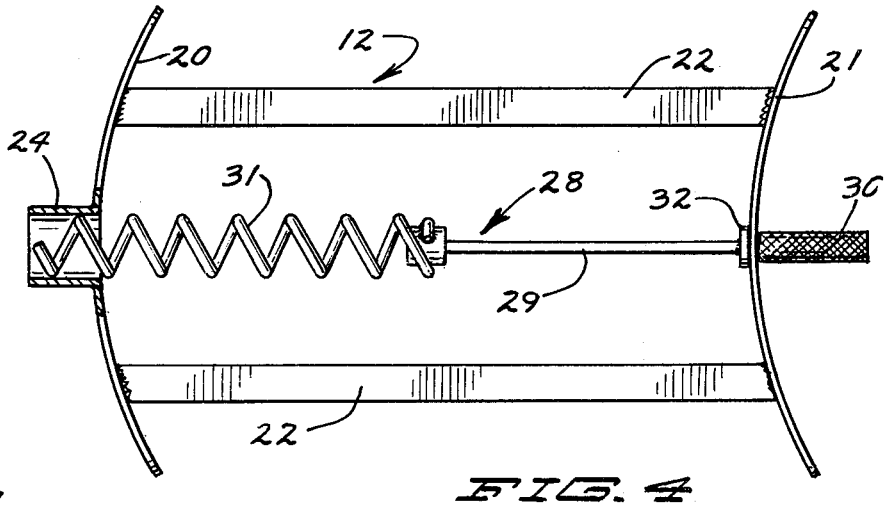
FIG. 4

TOBACCO POUCH WITH EJECTOR MECHANISM

BACKGROUND OF THE INVENTION

Those who smoke pipes often find it desirable to carry a pouch of tobacco on their person for purposes of refilling the pipe. In the most common type of pouch the user dips the pipe into the pouch and pushes the tobacco by hand into the pipe bowl. In certain situations this is undesirable as the smoker's hands may be contaminated or gloved. There may also be conditions particularly outdoors which may cause tobacco to become wet, blown away, spilled, etc.

Accordingly it is desirable that a tobacco pouch have some means for automatically dispensing the tobacco into the bowl of the pipe. Others have heretofore designed such pouches. Examples of the same are found in U.S. Pat. Nos. 62,448; 706,648; 1,606,988; and 3,570,659. Each of these patents discloses a structure combining a tobacco pouch with some sort of device for dispensing the tobacco therefrom.

While the pouches described in the aforementioned patents are designed for the same purpose, they are not adapted to dispense, load and compact all cuts of tobacco. Moreover the dispensing mechanisms are either relatively expensive to manufacture or do not lend themselves to compact carrying in the user's coat pocket or the like.

SUMMARY OF THE INVENTION

The present invention is believed to present a tobacco pouch which semi-automatically dispenses, loads and compacts tobacco into the bowl of a pipe and which yet can be manufactured and sold at a very reasonable cost.

A more specific object of the invention is to provide a compact tobacco pouch with a built in ejector mechanism which is adapted to gradually discharge pipe tobacco of various cuts into a pipe bowl and at the same time compact the tobacco in the bowl.

With these and other objects in view the invention broadly comprises a common generally rectangular shaped tobacco pouch with a zipper type closure along the top edge. A framework within the pouch retains the pouch in a distended condition and includes a filler tube which projects through one end wall of the pouch and an elongated auger in axial alignment with the tube having one end loosely disposed within the tube and the other end connected to a control outside of the other end of the pouch whereby as the control is manually rotated the auger will move tobacco in the pouch outwardly through the filler tube.

BRIEF DESCRIPTION OF THE DRAWING

In the drawing:

FIG. 1 is a perspective view of the pouch in tobacco discharging position relative to a pipe bowl.

FIG. 2 is a longitudinal section through the pouch taken on line 2—2 of FIG. 1 but showing the cap in closure position over the discharge tube.

FIG. 3 is a longitudinal section through the pouch taken on line 3—3 of FIG. 2 and with the cap removed.

FIG. 4 is a plan view of the auger and internal framework of the pouch removed therefrom.

FIG. 5 is a front end elevation of the framework.

DESCRIPTION OF THE PREFERRED EMBODIMENT

Referring now more particularly to the drawing reference characters will be used to denote like parts or structural features in the different views. The pouch is denoted generally by the numeral 10 and comprises an outer bag or housing 11 which is retained in a distended condition by a framework assembly denoted generally at 12. The bag 11 is formed of flexible sheet material and has flat side walls 14, connected by a front wall 15, rear wall 16, bottom wall 17 and a zipper closure 18 extending along a top wall 19.

The framework 12 fits snugly within the bag 11 and comprises arcuate front and rear ribs denoted respectively at 20 and 21 retained in longitudinally spaced condition by the elongated members 22. The front rib 20 has an aperture at the longitudinal center thereof which receives and secures a discharge tube 24. Tube 24 extends forwardly through an opening in the front wall 15 of the pouch or bag 11 and is in open communication with the chamber 25 within the bag. A cap 26 having a friction fit with the tube 24 is provided to close the end of the tube.

The auger mechanism is designated generally by the number 28. It comprises a rotary shaft 29 which is journaled in the center of rear rib 21 of the framework 12 having a handle 30 at its rear end for rotation thereof and a spiral spring auger 31 mounted on and extending forwardly from the other end thereof into the discharge tube 24. It will be understood that as handle 30 is turned the auger 31 will be rotated.

The spring auger 31 fits loosely within the tube 24 for free rotation therein and handle 30 may be knurled as shown in FIG. 1 to facilitate firm manual gripping. A bearing member 32 on the shaft 29 prohibits longitudinal movement of the shaft relative to rib 21.

In use of the pouch it is initially filled with pipe tobacco T through the zipper closure 18. In carrying the pouch the cap 26 is placed over the end of discharge tube 24. To fill the bowl of pipe P the cap 26 is removed and with one hand supporting the pipe and the open end of the pouch the user turns handle 30 with his other hand. This causes the auger 31 to move the tobacco granules out through the tube 24 into the pipe as shown in FIG. 1. When the pipe bowl has been filled the tube 24 may then be used to tamp the tobacco down in the bowl with auger 31 restricting free flow of tobacco from the pouch out through tube 24.

It is found that the spring auger 31 will effectively dispense virtually all cuts of tobacco. Moreover the main body of tobacco within the pouch 10 is sealed from outside air. The pouch may be used outside in all types of weather conditions with or without gloved hands.

The spiral spring 31 floats within the tube 24 and accordingly cannot be wedged by tobacco particles against a wall. At the same time it discharges tobacco from the pouch and actually serves to compact tobacco particles in a pipe bowl. The invention accordingly economically and effectively carries out the aforementioned objectives.

Having now therefore fully illustrated and described my invention, what I claim to be new and desire to protect by United States Letters Patent is:

1. In a tobacco pouch for containing and dispensing a quantity of pipe tobacco, (a) a bag of flexible sheet material, (b) said bag having flat side walls connected by front, rear, top and bottom walls with a zipper closure extending along the top wall, (c) the bag held in a distended condition by a framework having rigid front and rear ribs extending along the bag front and rear walls and elongated members interconnecting the ribs for retaining the ribs in longitudinally spaced condition, (d) the front rib having an aperture at the longitudinal center thereof which receives and secures the end of a discharge tube which extends through an opening in the front wall of the bag, (e) a spiral spring auger member disposed within the bag in axial alignment with the tube and having one end fitting loosely within the tube, and (f) a handle member connected to the auger member and extending through the rear rib and rear wall whereby as the handle member is rotated the auger member will move tobacco within the bag toward and outwardly through said opening and tube.

* * * * *